US010231898B2

(12) United States Patent
Yang

(10) Patent No.: US 10,231,898 B2
(45) Date of Patent: Mar. 19, 2019

(54) MASSAGE APPARATUS

(71) Applicant: Tsung-Hsun Yang, Taichung (TW)

(72) Inventor: Tsung-Hsun Yang, Taichung (TW)

( * ) Notice: Subject to any disclaimer, the term of this patent is extended or adjusted under 35 U.S.C. 154(b) by 561 days.

(21) Appl. No.: 14/990,029

(22) Filed: Jan. 7, 2016

(65) Prior Publication Data

US 2017/0196753 A1 Jul. 13, 2017

(51) Int. Cl.
*A61H 7/00* (2006.01)

(52) U.S. Cl.
CPC ..... *A61H 7/007* (2013.01); *A61H 2201/0165* (2013.01); *A61H 2201/1207* (2013.01); *A61H 2201/1669* (2013.01); *A61H 2203/0406* (2013.01); *A61H 2203/0425* (2013.01)

(58) Field of Classification Search
CPC ..... A61H 7/007; A61H 2203/0425; A61H 2201/0165; A61H 2201/1669; A61H 2201/1207; A61H 2203/0406
See application file for complete search history.

(56) References Cited

U.S. PATENT DOCUMENTS 6,364,850 B1 * 4/2002 Wang ..... A61H 1/00 601/101
2004/0267168 A1 * 12/2004 Feng ..... A61H 31/00 601/15
2005/0113636 A1 * 5/2005 Tucker ..... A61H 19/44 600/38
2011/0218465 A1 * 9/2011 Yang ..... A61H 1/00 601/18
2014/0336549 A1 * 11/2014 Yang ..... A61H 7/004 601/112

FOREIGN PATENT DOCUMENTS

EP 2359795 A1 8/2011
JP 2002136561 A 5/2002

OTHER PUBLICATIONS

EP search report in corresponding EP application No. 16150580.5 dated Jun. 23, 2016 (7 pages).

* cited by examiner

*Primary Examiner* — Quang D Thanh
(74) *Attorney, Agent, or Firm* — Trop Pruner & Hu, P.C.

(57) ABSTRACT

A message apparatus includes a support frame, a moving unit, and a massage unit. The support frame includes an upright base wall. The moving unit includes two upright guide rails mounted to one of inner and outer surfaces of the base wall, a support seat including two slide members that engage respectively and slidably the guide rails, and a driving member disposed at an inner side of the inner surface of the base wall for driving the slide movement of the support seat. The massage unit is disposed at an outer side of the outer surface of the base wall, and includes a motor, a driving shaft driven rotatably by the motor, and a massage head coupled co-rotatably to the driving shaft.

8 Claims, 4 Drawing Sheets

MASSAGE APPARATUS

FIELD The disclosure relates to a massage apparatus, and more particularly to a massage apparatus that provides enhanced comfort and that consumes less power.

BACKGROUND

Referring to FIG. 1, a conventional massage apparatus 8, such as that disclosed in Taiwan Utility Model Patent No. M450373, includes a support frame 81, a moving unit 82, and a massage unit 83.

The support frame 81 has an upright base wall 811, two side walls 812 that, are connected perpendicularly to the upright base wall 811, and an elongated groove 813 that extends through the upright base wall 81.

The moving unit 82 has two upright guide rails 821 that are mounted respectively on the side walls 812, a support seat 822 that is disposed on the upright guide rails 821, and a driving member (not shown). The support seat 822 has an abutting wall 823 that is parallel to the upright base wall 811, two support walls 824 that are connected perpendicularly to the abutting wall 823, and two slide seats 825 that are disposed respectively on the support walls 824 and that engage slidably with the upright guide rails 821.

The massage unit 83 has a motor 831 that is disposed on the abutting wall 823 of the support seat 822, a driving shaft 832 that is connected to the motor 831 and that extends from the motor 831 through the elongated groove 813, and a massage head 833 that is disposed on the driving shaft 832.

In the conventional massage apparatus 8, however, since the motor 831 of the massage unit 83 is connected to the abutting wall 823 of the support seat 822, and since the driving shaft 832 extends through the elongated groove 813 so that a distance of the driving shaft 832 between the massage head 833 and the motor 831 is relatively long, the massage apparatus 8 tends to consume more power and rock too violently for comfort Another disadvantage of the conventional massage apparatus 8 is that the support seat 822 of the same is bended from a metal plate into the shape as shown in FIG. 1. Therefore, due to the resiliency of the metal material, it is likely that the support walls 824 of the support seat 822 will recover in shape to be coplanar with the abutting wall 823, thereby causing the slide seats 825 to deviate from their original positions and compromising the sliding precision or the slide seats 825 on the upright guide rails 821, and in turn, result in wearing between the slide seats 825 and the upright guide rails 821 due to such displacement.

SUMMARY

Therefore, an object of the disclosure is to provide a massage apparatus that, can alleviate at least one of the drawbacks of the prior art.

According to the disclosure, the massage apparatus includes a support frame, a moving unit, and a massage unit.

The support frame includes an upright base wall that has opposite inner and outer surfaces.

The moving unit includes two upright guide rails that are mounted to one of the inner and outer surfaces of the base wall of the support frame, a support seat that includes two slide members that engage respectively and slidably the guide rails, and a driving member that is disposed at an inner side of the inner surface of the base wall of the support frame for driving the slide movement of the support seat.

The massage unit is disposed at an outer side of the outer surface of the base wall of the support frame, is connected to the support seat, and includes a motor, a driving shaft that is driven rotatably by the motor, and a massage head that is coupled co-rotatably to the driving shaft.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
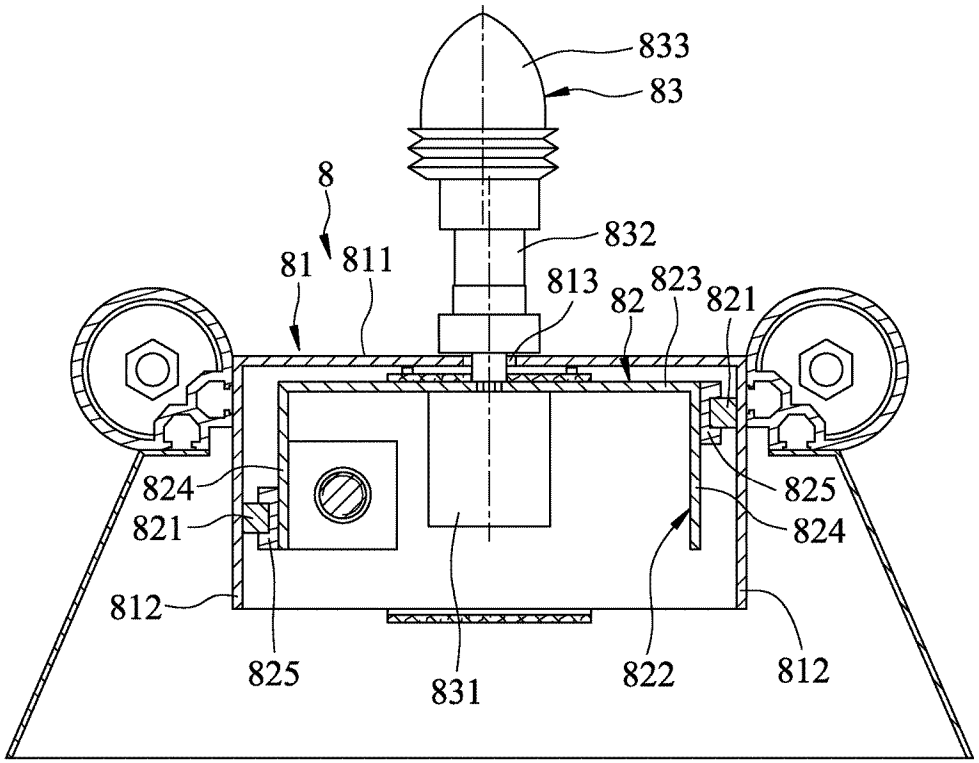
FIG.1 PRIOR ART
FIG. 1 is a sectional view of the conventional massage apparatus.

Before the disclosure is described in greater detail, it should be noted that like elements are denoted by the same reference numerals throughout the disclosure.

Figure 2:
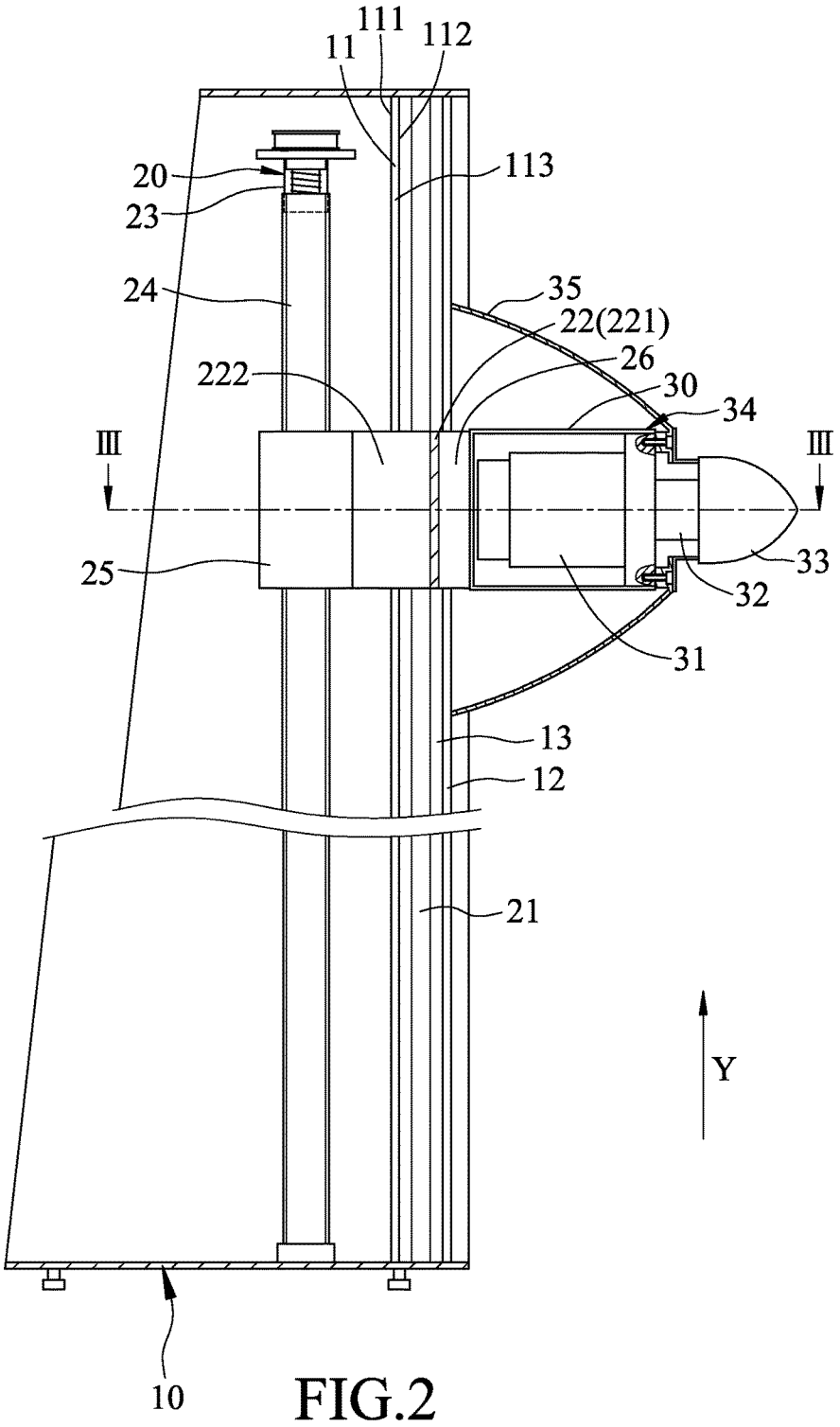
FIG. 2 is a fragmentary sectional view of a first embodiment of the massage apparatus according to the disclosure.
Figure 3:
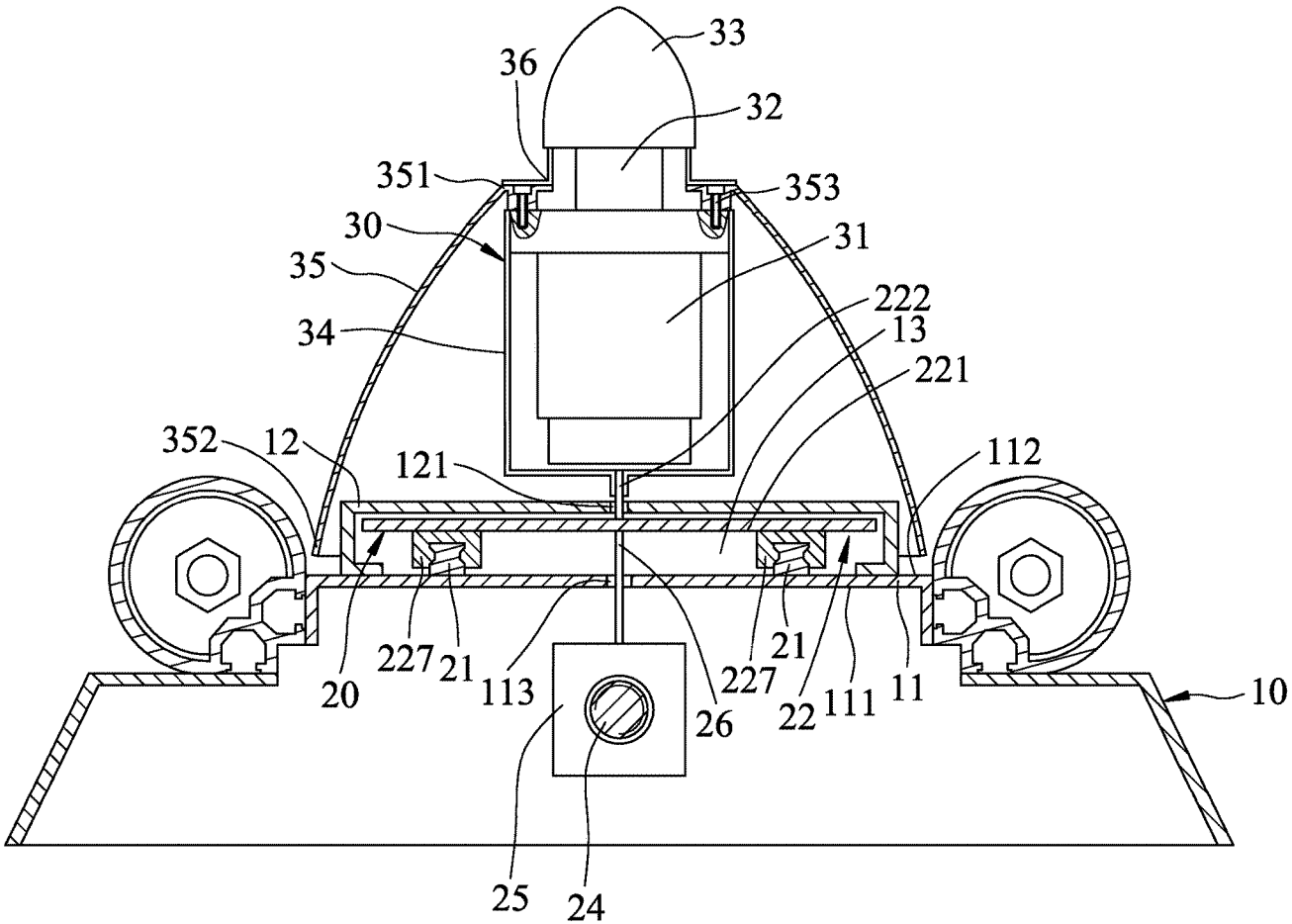
FIG. 3 is a sectional view of the first embodiment taken alone Line III-III of FIG. 2.

Referring to FIGS. 2 and 3, the first embodiment of the massage apparatus according to the disclosure includes a support frame 10, a moving unit 20, and a massage unit 30.

The support frame 10 is able to stand stably on the ground in an upright manner, and includes an upright base wall 11 that extends in a vertical direction (Y), a protect cover 12 connected fixedly to the base wall 11, and an inner space 13 that is formed between the base wall 11 and the protect cover 12. The base wall 11 has opposite inner and outer surfaces 111, 112, and an upright elongated groove 113 that extends through the inner and outer surfaces 111, 112. The protect cover 12 is connected fixedly to the outer surface 112, cooperates with the base wall 11 to define the inner space 13 therebetween, and is formed with a guide groove 121.

The moving unit 20 includes two upright guide rails 21 that extend in the vertical direction (Y) and that are mounted to the outer surface 112 of the base wall 11 of the support frame 10, a support seat 22 that includes two slide members 227 engaging respectively and slidably the guide rails 21, a driving member 23 that is disposed at an inner side of the inner surface 111 of the base wall 11 for driving the slide movement of the support seat 22, a threaded shaft 24 that extends in the vertical direction (Y), that is disposed at the inner side of the inner surface 111 of the base wall 11, and that is driven rotatably by the driving member 23, a threaded sleeve 25 that is sleeved on and drivingly engages the threaded shaft 24, and a guide member 26 that extends slidably through the elongated groove 113 and that interconnects the threaded sleeve 25 and the support seat 22 such that the support seat 22 is co-movable with the threaded sleeve 25. The guide rails 21 and the support seat 22 are disposed in the inner space 13 of the support frame 10. In this embodiment, the driving member 23 is configured as a motor.

The support seat 22 of the moving unit 20 is disposed at an outer side of the outer surface 112 of the base wall 11 of the support frame 10 and between the base wall 11 and the massage unit 30. The support seat 22 further includes a main seat wall 221 that is parallel to the base wall 11, and a connecting seat wall 222 that is connected perpendicularly and fixedly to the main seat wall 221, that extends through the guide groove 121, and that is connected fixedly to the massage unit 30. The two slide members 227 are disposed on the main seat wall 221.

The massage unit 30 is connected to the support seat 22 via the connecting seat wall 222, is disposed at the outer side of the outer surface 112 of the base wall 11 of the support frame 10, and includes a motor 31, a driving shaft 32 that is driven rotatably by the motor 31, a massage head 33 that is coupled co-rotatably to the driving shaft 32, a housing 34 that encloses the motor 31 therein, a substantially frusto-conical shell 35 that covers the housing 34, and a protect sleeve 36 that is fixed to the shell 35.

The shell 35 has a fixing end portion 351 that is disposed between the motor 31 and the massage head 33, that is connected fixedly to the housing 34, and that is fixed to the motor 31 via a plurality of screws 353, and an enlarged end portion 352 that is opposite to the fixing end portion 351 and that is adjacent to the base wall 11. A diameter of the shell 35 increases gradually from the fixing end portion 351 to the enlarged end portion 352.

The protect sleeve 36 has an end that is connected fixedly to the fixing end portion 351 of the shell 35, and an opposite end that abuts against a root portion of the massage head 33.

Further referring to FIGS. 2 and 3, when the threaded shaft 24 of the moving unit 20 is driven to rotate by the driving member 23, the threaded sleeve 25 is also driven to move up and down, thereby driving the main seat wall 221 of the support seat 22 to move up and down by virtue of the guide member 26 that interconnects the threaded sleeve 25 and the support seat 22. In addition, by virtue of the slide members 227 that engage slidably and respectively the guide rails 21, the main seat wall 221 is able to move smoothly up and down along the guide rails 21 relative to the base wall 11. At the same time, by being fixedly connected to the main seat wall 221, the connecting seat wall 222 enables the entire massage unit 30 to be driven to move up and down relative to the support frame 10. A user standing or sitting in front of the support frame 10 of the massage apparatus can thereby be kneaded and massaged to achieve a purpose of this embodiment.

When massaging the user, since the driving shaft 32 of the massage unit 30 has a short length due to the configuration that the massage unit 30 is disposed at the outer side of the outer surface 112 of the base wall 11 (i.e., the motor 31 positioned closer to the user), the massage head 33 rocks relatively less violently, emits less noise, and consumes less power for the benefit of the user.

Other advantages of this embodiment include:

1. The protect cover 12 shields the guide rails 21 and the main seat wall 221 of the support seat 22 from dust, liquid, and other foreign matter, so that the sliding movement of the support seat 22 can remain smooth and unhindered.

2. The shell 35 contributes to the aesthetic appeal of this embodiment, and prevents the user from coming into direct and uncomfortable contact with the housing 34.

3. The protect sleeve 36 can be configured as a soft, gel casing commonly seen on the market to prevent dust from accumulating and to prevent the screws 353 from being exposed.

It should be noted that since the guide rails 21 of this embodiment are mounted to the base wall 11, and since the main seat wall 221 of the support seat 22 is already formed to be parallel to the base wall 11, any post-assembly scraping damage to the guide rails 21 due to displacement from elastic recovery of materials can be avoided.

Figure 4:
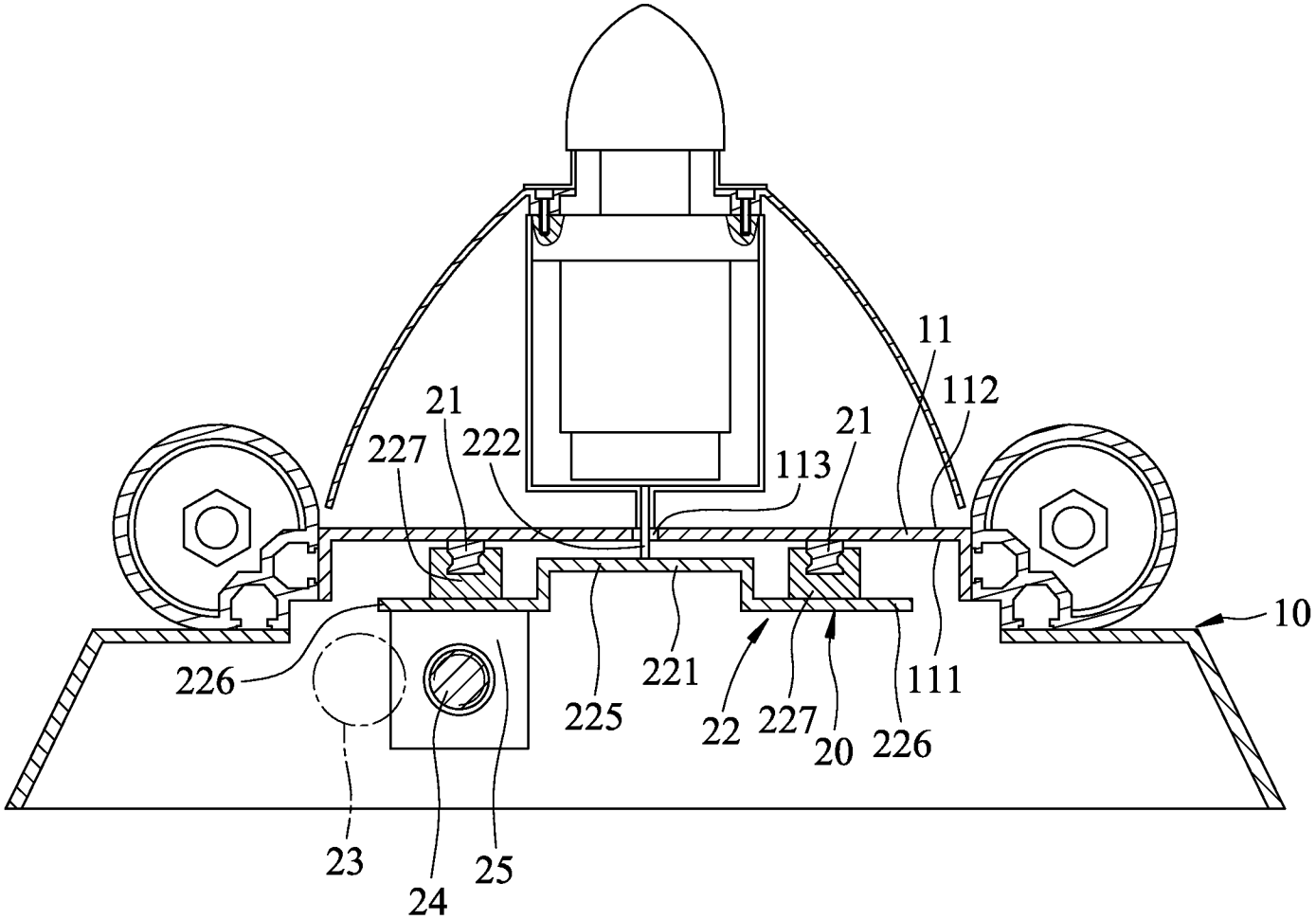
FIG. 4 is a sectional view of a second embodiment of the massage apparatus according to the disclosure.

Referring to FIG. 4, the second embodiment of the massage apparatus according to the disclosure is similar in function and structure to the first embodiment, except that in the second embodiment, the main seat wall 221 of the support seat 22 is disposed at the inner side of the inner surface 111 of the upright base wall 11 of the support frame 10 (i.e., the base wall 11 is between the support seat 22 and the massage unit 30), and has a stepped cross-section in a horizontal direction that is perpendicular to the vertical direction (Y). The main seat wall 221 further has a middle portion 225, and two connecting portions 226 that are connected respectively to opposite ends of the middle portion 225 and that are mounted respectively with the slide members 227. A (distance between the base wall 11 and the middle portion 225 of the main seat wall 221 is shorter than that between the base wall 11 and any one of the connecting portions 226 of the main seat wall 221.

The guide rails 21 of the second embodiment are mounted to the inner surface 111 of the base wall 11, and the support seat 22 and the threaded shaft 24 are disposed at the inner side of the inner surface 111. The connecting seat wall 222 of the support seat 22 of this embodiment extends slidably through the elongated groove 113. The threaded sleeve 25 of this embodiment is connected fixedly and directly to the main seat wall 221.

The second embodiment has the same advantages as the first embodiment.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A massage apparatus comprising:

a support frame including an upright base wall that has opposite inner and outer surfaces;

a moving unit including two upright guide rails that are mounted to one of said inner and outer surfaces of said upright base wall of said support frame, a support seat that includes two slide members engaging respectively and slidably said upright guide rails, and a driving member that is disposed at an inner side of said inner surface of said upright base wall of said support frame for driving the slide movement of said support seat; and a massage unit disposed at an outer side of said outer surface of said upright base wall of said support frame and connected to said support seat, and said massage unit including a motor, a driving shaft that is driven rotatably by said motor, and a massage head that is coupled co-rotatably to said driving shaft;

wherein said massage unit further includes a housing enclosing said motor therein; and wherein said massage unit further includes a shell covering said housing, and said shell having a fixing end portion that is disposed between said motor and said massage head, and said shell is connected fixedly to said housing, and said shell having an enlarged end portion that is opposite to said fixing end portion and adjacent to said upright base wall, and a diameter of said shell increasing gradually from said fixing end portion to said enlarged end portion.

2. The massage apparatus as claimed in claim 1, wherein:
said upright guide rails of said moving unit are mounted to said outer surface of said upright base wall of said support frame; and
said support seat of said moving unit is disposed at the outer side of said outer surface of said upright base wall of said support frame and between said upright base wall and said massage unit, and further includes
a main seat wall parallel to said upright base wall of said support frame, and
a connecting seat wall connected perpendicularly and fixedly to said main seat wall, and connected fixedly to said massage unit.

3. The massage apparatus as claimed in claim 1, wherein:
said upright base wall of said support frame further has an upright elongated groove extending through said inner and outer surfaces of said upright base wall;
said upright guide rails of said moving unit are mounted to said inner surface of said upright base wall of said support frame; and
said support seat of said moving unit is disposed at the inner side of said inner surface of said upright base wall of said support frame, and further includes
a main seat wall, and
a connecting seat wall connected perpendicularly and fixedly to said main seat wall, extending through said upright elongated groove, and connected fixedly to said massage unit.

4. The massage apparatus as claimed in claim 3, wherein said moving unit further includes:
a threaded shaft disposed at the inner side of said inner surface of said upright base wall of said support frame, and driven rotatably by said driving member; and
a threaded sleeve connected fixedly to said main seat wall of said support seat, and drivingly engaging said threaded shaft.

5. The massage apparatus as claimed in claim 1, wherein said massage unit further includes a protect sleeve having an end that is connected fixedly to said fixing end portion of said shell, and an opposite end that abuts against said massage head.

6. A massage apparatus comprising:
a support frame including an upright base wall that has opposite inner and outer surfaces;
a moving unit including
two upright guide rails that are mounted to one of said inner and outer surfaces of said upright base wall of said support frame,
a support seat that includes two slide members engaging respectively and slidably said upright guide rails, and
a driving member that is disposed at an inner side of said inner surface of said upright base wall of said support frame for driving slide movement of said support seat; and
a massage unit disposed at an outer side of said outer surface of said upright base wall of said support frame and connected to said support seat, and said massage unit including a motor, a driving shaft that is driven rotatably by said motor, and a massage head that is coupled co-rotatably to said driving shaft;
wherein said upright guide rails of said moving unit are mounted to said outer surface of said upright base wall of said support frame;
wherein said support seat of said moving unit is disposed at the outer side of said outer surface of said upright base wall of said support frame and between said upright base wall and said massage unit, and further includes
a main seat wall parallel to said upright base wall of said support frame, and
a connecting seat wall connected perpendicularly and fixedly to said main seat wall, and connected fixedly to said massage unit;
wherein said upright base wall of said support frame further has an upright elongated groove extending through said inner and outer surfaces of said upright base wall; and
wherein said moving unit further includes
a threaded shaft disposed at the inner side of said inner surface of said upright base wall of said support frame, and driven rotatably by said driving member,
a threaded sleeve drivingly engaging said threaded shaft, and
a guide member extending through said upright elongated groove and interconnecting said threaded sleeve and said main seat wall of said support seat such that said support seat is co-movable with said threaded sleeve.

7. The massage apparatus as claimed in claim 6, wherein:
said support frame further includes a protect cover connected fixedly to said outer surface of said upright base wall, cooperating with said upright base wall to define an inner space therebetween, and formed with a guide groove; said connecting seat wall of said support seat extends through said guide groove; and said upright guide rails and said support seat are disposed within said inner space.

8. A massage apparatus comprising:
a support frame including an upright base wall that has opposite inner and outer surfaces;
a moving unit including
two upright guide rails that are mounted to one of said inner and outer surfaces of said upright base wall of said support frame,
a support seat that includes two slide members engaging respectively and slidably said upright guide rails, and a driving member that is disposed at an inner side of said inner surface of said upright base wall of said support frame for driving slide movement of said support seat; and
a massage unit disposed at an outer side of said outer surface of said upright base wall of said support frame and connected to said support seat, and said massage unit including a motor, a driving shaft that is driven rotatably by said motor, and a massage head that is coupled co-rotatably to said driving shaft;
wherein said upright base wall of said support frame further has an upright elongated groove extending through said inner and outer surfaces of said upright base wall;
wherein said upright guide rails of said moving unit are mounted to said inner surface of said upright base wall of said support frame;
wherein said support seat of said moving unit is disposed at the inner side of said inner surface of said upright base wall of said support frame, and further includes
a main seat wall, and
a connecting seat wall connected perpendicularly and fixedly to said main seat wall, extending through said upright elongated groove, and connected fixedly to said massage unit;
wherein said moving unit further includes a threaded shaft disposed at the inner side of said inner surface of said upright base wall of said support frame, and driven rotatably by said driving member, and a threaded sleeve connected fixedly to said main seat wall of said support seat, and drivingly engaging said threaded shaft; and wherein said main seat wall of said support seat has a stepped cross-section, said main seat wall further having a middle portion and two connecting portions that are connected respectively to opposite ends of said middle portion and that are mounted respectively with said slide members, a distance between said upright base wall and said middle portion of said main seat wall being shorter than that between said upright base wall and any one of said connecting portions of said main seat wall.

* * * * *